US009783210B2

(12) United States Patent
Thierschmann et al.

(10) Patent No.: US 9,783,210 B2
(45) Date of Patent: Oct. 10, 2017

(54) ARRANGEMENT OF A PASSENGER INFORMATION SYSTEM IN A RAIL VEHICLE

(71) Applicant: SIEMENS AKTIENGESELLSCHAFT, Munich (DE)

(72) Inventors: Ralf Thierschmann, Ratingen (DE); Thomas Vogeley, Ahnatal (DE)

(73) Assignee: Siemens Aktiengesellschaft, Munich (DE)

( * ) Notice: Subject to any disclaimer, the term of this patent is extended or adjusted under 35 U.S.C. 154(b) by 90 days.

(21) Appl. No.: 14/888,153

(22) PCT Filed: Apr. 9, 2014

(86) PCT No.: PCT/EP2014/057117
§ 371 (c)(1),
(2) Date: Oct. 30, 2015

(87) PCT Pub. No.: WO2014/177348
PCT Pub. Date: Nov. 6, 2014

(65) Prior Publication Data

US 2016/0075349 A1 Mar. 17, 2016

(30) Foreign Application Priority Data

Apr. 30, 2013 (DE) ..... 10 2013 207 947

(51) Int. Cl.
*B61L 15/00* (2006.01)
*B61D 19/02* (2006.01)
*G09F 21/04* (2006.01)

(52) U.S. Cl.
CPC ..... *B61D 19/02* (2013.01); *B61L 15/009* (2013.01); *B61L 15/0045* (2013.01); *G09F 21/04* (2013.01)

(58) Field of Classification Search
CPC ..... B61L 15/00; B61L 15/009; B61D 19/00; B61D 19/02; H04L 12/28; H04L 12/44; H04L 12/56
See application file for complete search history.

(56) References Cited

U.S. PATENT DOCUMENTS 5,701,980 A * 12/1997 Lee ..... B60L 1/04 191/4
6,374,176 B1 * 4/2002 Schmier ..... G08G 1/123 340/988

(Continued)

FOREIGN PATENT DOCUMENTS

DE 29819742 U1 1/1999
DE 102005001650 A1 7/2006

(Continued)

OTHER PUBLICATIONS

Dorn, H., "Fahrgastinformationssysteme—Gegenwart und Zukunft—Passenger Information Systems—Presence and Future", Zevrail—Glaswers Annalen, 2003, pp. 370-377, vol. 127, No. 8, Georg Siemens Verlag, Berlin, Germany.

(Continued)

*Primary Examiner* — Jason C Smith
(74) *Attorney, Agent, or Firm* — Laurence Greenberg; Werner Stemer; Ralph Locher

(57) ABSTRACT

A rail vehicle for public transport includes at least one door for separating two inner spaces of the rail vehicle and a lintel for the door. The lintel has at least one electronic information system for passengers.

6 Claims, 1 Drawing Sheet

(56) References Cited

U.S. PATENT DOCUMENTS

| | | | | |
|---|---|---|---|---|
| 8,532,851 | B2 * | 9/2013 | Kondo | B61L 15/0027 701/19 |
| 2002/0163895 | A1 * | 11/2002 | Haller | H04L 12/24 370/335 |
| 2003/0023979 | A1 * | 1/2003 | Emoto | B61D 49/00 725/75 |
| 2004/0163451 | A1 * | 8/2004 | Kim | G01M 17/08 73/115.01 |
| 2014/0049408 | A1 * | 2/2014 | Morimoto | B61L 15/0072 340/988 |
| 2014/0224149 | A1 * | 8/2014 | Thierschmann | B61D 1/00 105/344 |
| 2016/0075349 | A1 * | 3/2016 | Thierschmann | B61L 15/0045 105/343 |

FOREIGN PATENT DOCUMENTS

| | | | | |
|---|---|---|---|---|
| DE | 102008054131 | A1 | 5/2010 | |
| EP | 2407369 | A1 | 1/2012 | |
| WO | 2006072611 | A1 | 7/2006 | |
| WO | WO 2006072611 | A1 * | 7/2006 | B61L 15/0027 |

OTHER PUBLICATIONS

Fischer, J.W., "Neue Schnelle, komfortable Züge mit Neigetechnik für die Deutsche Bahn AG", Zeitschrift fur Eisenbahnwesen und Verkehrstechnik, Die Eisenbachtechnik + Glasers Annalen, 1998, pp. 416, 418-430, vol. 122, No. 9/10, Georg Siemens Verlagsbuchandlung, Berlin, Germany.

* cited by examiner

ARRANGEMENT OF A PASSENGER INFORMATION SYSTEM IN A RAIL VEHICLE

BACKGROUND OF THE INVENTION

Field of the Invention

The invention relates to a rail vehicle for public transport having at least one door for separating two inner spaces of the vehicle.

Rail vehicles of the type mentioned in the introduction are known from public transport. Furthermore, it is known that rail vehicles comprise electronic information systems for passengers. Thus, for example, the ICE3 of Deutsche Bahn (German Rail) has a display of an electronic information system for passengers, which is arranged in the region of the entrance location on a partition wall between the region of the entrance location and the passenger space by being placed on the partition wall.

BRIEF SUMMARY OF THE INVENTION

An object of the invention is to provide a rail vehicle which is simple to produce.

The object is achieved with the subject matter of the independent patent claim described below. Developments and embodiments of the invention are set out in the features of the dependent patent claims.

A rail vehicle according to the invention for public transport comprises at least one door for separating two inner spaces of the vehicle. According to the invention, a door lintel of the door comprises at least one electronic information system for passengers. The electronic information system for passengers is in particular arranged not only in the door lintel, it forms together with the door lintel a unit which can be mounted. The door lintel is thus pre-assembled with the electronic information system for passengers and installed as a whole in the rail vehicle. Corresponding interfaces for securing the door lintel together with the electronic information system for passengers and where applicable for connecting the electronic information system for passengers, for example, by cabling by means of plug contacts, are provided both on the rail vehicle and on the door lintel itself. In one embodiment, the door lintel is thus secured, in particular by securing means, to a shell of the rail vehicle, for example, screwed to it. The rail vehicle has a bearing frame, also called a shell, which comprises at least one device for securing the door lintel to the shell. In the example mentioned above, these would be holes.

The production of the rail vehicle is significantly simplified since the electronic information system for passengers does not have to be additionally assembled in the rail vehicle, but instead is already secured and connected when the door lintel is assembled.

According to a development of the invention, the electronic information system for passengers comprises at least one display surface, for example, a display. The display surface is, for better readability, in particular inclined in the direction toward one of the inner spaces which are separated by the door. The door lintel and the at least one display surface are in particular pre-assembled and form a unit which can be mounted.

In another embodiment, the electronic information system for passengers comprises two display surfaces which, at different sides of the door, face into the inner spaces of the vehicle separated by the door. It is thereby possible to display at different sides of the door passenger information which can be read at both sides of the door, that is to say, from both passenger spaces.

Another development of the invention makes provision for the door lintel to comprise a device for, in particular, direct assembly of the door on the door lintel, for example, for the door lintel to have at least one, in particular vertically extending, hole for receiving a vertically extending shaft about which at least one door leaf of the door can be pivoted. The shaft can consequently be referred to as a pivot, rotation or rotary shaft of the at least one door leaf. In a rotating door, a door leaf is also referred to as a door wing.

In a development, the door lintel and the door, in particular the door leaf, form a unit which can be mounted. The door leaf is thus pre-assembled with the door lintel, for example, by the pivot shaft being radially supported in the door lintel, that is to say, permitting a rotation of the shaft, but preventing a translation of the shaft beyond a predetermined extent.

Alternatively, the door may be constructed as a sliding door.

The door lintel may comprise a device for assembly of a door frame for assembling the door on the door frame. In particular, the door lintel, together with the electronic information system for passengers, and the door frame again then form a unit which can be assembled.

The electronic information system for passengers provides, for example, the following information for passengers:

name of the next stop, time, travel time to the next stop and/or current speed of the vehicle. It is constructed accordingly, in particular as a display, in order to indicate different texts.

In order to further separate the two inner spaces of the rail vehicle, which are separated from each other by the door, in a development the rail vehicle further comprises a partition wall. The door is in particular arranged between two partition wall elements of the partition wall. They are in particular secured to the door lintel. The door lintel thus has, for example, over the inner width of the rail vehicle, a cross-member which is connected to the shell of the rail vehicle and to which in turn the partition wall or the partition wall elements of the partition wall are secured. A variant involves the door lintel being arranged in the partition wall, which comprises the door lintel. The partition wall and the door lintel form a unit which can be mounted.

The invention permits numerous embodiments. It is explained in greater detail with reference to the following Figures in which an embodiment is illustrated in each case. Elements which are identical in the Figures are indicated with the same reference numerals.

DESCRIPTION OF THE INVENTION

Figure 1:
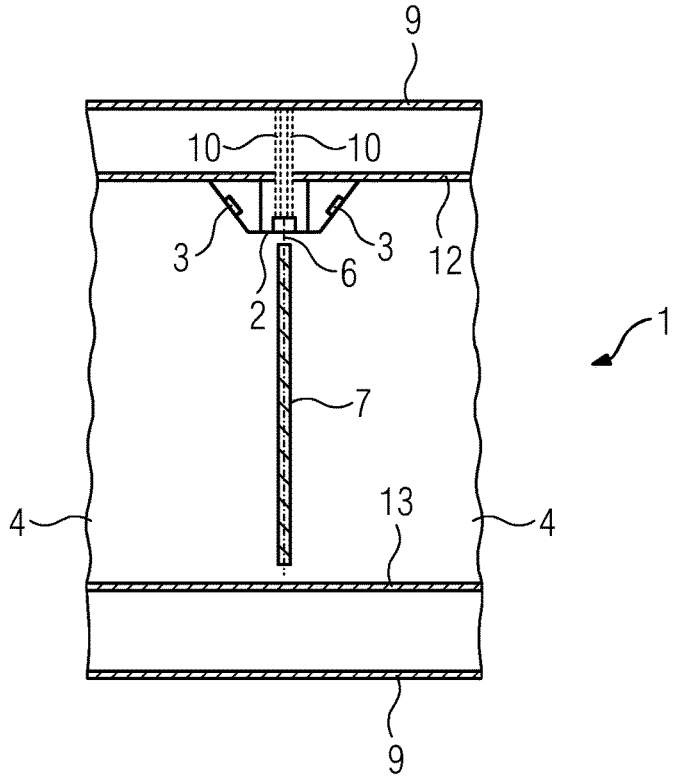
FIG. 1 is a cross section of a door lintel according to the invention.

FIG. 1 is a longitudinal section of a body of a rail vehicle. A door leaf 7 and a door lintel 2 of a door 1 are also illustrated in section. The door separates two inner spaces 4 of the rail vehicle, for example, passenger spaces, from each other. The door lintel 2 comprises in this instance two display surfaces 3 of an electronic information system for passengers, also referred to as a passenger information system. They are inclined toward the inner spaces 4. The door lintel 2 is consequently constructed so as to be trapezoidal in cross section. Since the electronic information system for passengers is part of the door lintel 2 and they are pre-assembled together as a unit which can be mounted, and finally assembled, a separate connection of the electronic information system for passengers, in particular the display surfaces 3, is no longer required.

The term door lintel, in the original sense of the word, is intended to refer to the upper portion of the opening, which portion carries the load of the wall regions above the door and directs them to the pillars of the opening. In this instance, the door lintel does not carry any load of the wall regions above the door. The door lintel 2 can consequently be formed by the at least one electronic information system for the passengers.

It is secured to a shell 9 of the body of the rail vehicle, indirectly, by the door lintel 2 being secured to a ceiling 12 of the body of the rail vehicle which in turn is secured to the shell 9 of the body of the rail vehicle, or directly, in particular by way of securing means, for example, screw connections. To this end, both the door lintel 2 and the shell 9 of the body of the rail vehicle have holes 10. The door lintel 2 is connected to the shell 9 in particular in a suspended manner.

The door lintel 2 further serves to secure the door leaf 7 to the body of the rail vehicle and to secure partition wall elements 8 of a partition wall to the body of the rail vehicle.

In this embodiment, the door leaf 7 is pivotably supported about a shaft 6 in the door lintel 2 and in a floor 13 of the body of the rail vehicle. To this end, the door lintel 2 and the floor 13 have correspondingly formed holes in order to receive and radially support the shaft 6.

Figure 2:
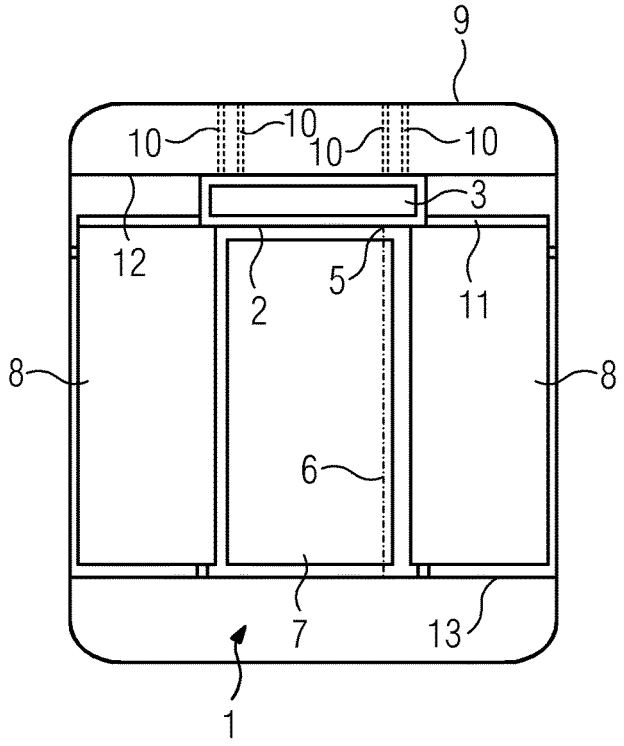
FIG. 2 is a plan view of the door lintel from FIG. 1.

FIG. 2 is a sectional plan view through a body of a rail vehicle having a door lintel 2 according to the invention.

The door lintel 2 comprises in addition to the display surfaces 3 a cross-member 11 which extends in this instance over the entire width of the inner space of the body of the rail vehicle. Via the cross-member 9, the door lintel 2 can be connected to the sides of the shell 9 of the rail vehicle. In this instance, however, it is secured exclusively in an upward direction to the shell 9. The cross-member 11 serves to secure the partition wall elements 8, which laterally surround the door leaf 7 of the door. The partition wall elements 8 can be secured to the cross-member 11, for example, they are screwed to the cross-member 11. By means of the cross-member 11, the partition wall elements 8 are accordingly connected to the shell 9 of the body of the rail vehicle. The partition wall elements 8 can also be directly secured to the door lintel 2. The door lintel 2 includes a device 5 for assembly of the door leaf 7 on the door lintel.

On the other hand, the cross-member 11 could also be positioned on the partition wall elements 8 and thus support the door lintel 2, wherein the partition wall elements 8 would take over the function of the pillars of the door or the door posts of a door frame, which is not the case in this instance.

The holes 10 serve to secure the door lintel 2 to the shell 9, in particular by way of securing means which are not illustrated in this instance. For example, the door lintel 2 is screwed to a ceiling 12 of the body, which in turn is secured to the shell 9 of the rail vehicle.

The invention claimed is:

1. A rail vehicle for public transport, the rail vehicle comprising:

two inner spaces;

at least one door separating said two inner spaces, said at least one door having two sides;

a door lintel for said at least one door, said door lintel having at least one electronic information system for passengers; and said at least one electronic information system including two display surfaces each disposed at a respective one of said sides of said at least one door and each facing into a respective one of said inner spaces separated by said at least one door.

2. The rail vehicle according to claim 1, wherein said at least one electronic information system includes at least one display surface for displaying passenger information.

3. The rail vehicle according to claim 1, wherein said at least one door has a door leaf, and said door lintel includes a device for assembly of said door leaf on said door lintel.

4. The rail vehicle according to claim 3, wherein said door lintel has at least one hole for receiving a vertically extending shaft about which said door leaf can be pivoted.

5. The rail vehicle according to claim 1, wherein said door lintel and said at least one electronic information system for passengers form a unit which can be mounted.

6. The rail vehicle according to claim 1, wherein said door lintel is secured to a shell of the rail vehicle.

* * * * *